US011950641B1

(12) United States Patent
Meng

(10) Patent No.: US 11,950,641 B1
(45) Date of Patent: Apr. 9, 2024

(54) BRA COVER AND AN ADJUSTABLE AND REMOVABLE BRA USING IT

(71) Applicant: Xianliang Meng, Kaifeng (CN)

(72) Inventor: Xianliang Meng, Kaifeng (CN)

( * ) Notice: Subject to any disclaimer, the term of this patent is extended or adjusted under 35 U.S.C. 154(b) by 0 days.

(21) Appl. No.: 18/236,417

(22) Filed: Aug. 22, 2023

(51) Int. Cl.
*A41C 3/14* (2006.01)
*A41F 15/00* (2006.01)

(52) U.S. Cl.
CPC ..... *A41C 3/144* (2013.01); *A41F 15/002* (2013.01)

(58) Field of Classification Search
CPC ..... A41C 3/144; A41F 15/002
See application file for complete search history.

(56) References Cited

U.S. PATENT DOCUMENTS 2,590,915 A * 4/1952 Allison ..... A41C 3/00 450/82
3,311,112 A * 3/1967 Murray ..... A41F 1/006 450/82
D578,277 S * 10/2008 Lung ..... D2/706
8,075,369 B2 * 12/2011 Hendrickson ..... A41C 3/04 450/86
8,221,186 B2 * 7/2012 Policaro ..... A41C 3/08 2/119
D709,670 S * 7/2014 Vericella ..... D2/708
9,027,164 B2 * 5/2015 Seiler ..... A41D 1/22 2/54
9,700,080 B1 * 7/2017 Hansraj ..... A41C 3/0021
10,342,269 B1 * 7/2019 Rutkoski ..... A41C 3/0057
11,116,259 B1 * 9/2021 Barrett ..... A41C 3/128
11,197,506 B2 * 12/2021 Arshava ..... A41C 3/0064
11,350,680 B2 * 6/2022 Rutkoski ..... A41C 3/0028
2009/0270013 A1 * 10/2009 Clair ..... A41C 3/08 450/38
2010/0105284 A1 * 4/2010 Policaro ..... A41C 3/08 450/86

* cited by examiner

*Primary Examiner* — Gloria M Hale
(74) *Attorney, Agent, or Firm* — Jose Cherson Weissbrot

(57) ABSTRACT

The present invention provides a bra cover and an adjustable and removable bra using it, the bra cover comprising a bra, a textile and a sling assembly, the bra comprising a bra strap and at least two pieces of bra pads, the sling assembly comprising at least two roots of shoulder strap and a band, the adjustable and removable bra comprising a fastening kit and a bra cover, the fastening kit comprising a plurality of attachment buckle and a plurality of adjustment buckle.

17 Claims, 10 Drawing Sheets

BRA COVER AND AN ADJUSTABLE AND REMOVABLE BRA USING IT

TECHNICAL FIELD

The present invention relates to the technical field of clothing, in particular to a bra cover and an adjustable and removable bra using it.

BACKGROUND

With the improvement of living standards and people's aesthetics, women's demand for bras is increasing. Most of the bras currently on the market can be exposed like suspenders to improve aesthetics, but such bras cannot be worn alone and need to be worn with different clothing, and the fixation of the bras will directly contact the skin causing discomfort to the wearer and cannot be applied to a variety of people, which greatly reduces the user's experience.

U.S. Pat. No. 8,152,591 discloses a basically triangular-shaped garment and bra accessory having a connecting band extending outwardly from the upper corner of the undergarment to encircle the shoulder straps of the bra. In addition, the lower corners can encircle the center portion of the bra, and the elastic material positioned along the upper edges of the undergarment allows the undergarment to be securely held against a woman's breasts while being worn by a user, thereby improving the firmness of the undergarment and making it less likely to come loose. However, this type of fixation can come into contact with the user's skin, resulting in uncomfortable wear and a reduced user experience.

U.S. Pat. No. 8,062,093 discloses a cleavage fitting for a bra that is used to prevent the exposure of cleavage in a woman's chest area. The cleavage fitting is designed to be removable, and the user has the option of attaching this piece of fabric to or removing it from the chest area of the bra. This feature will allow the user to remove this piece of fabric from the garment immediately after leaving a prohibited or restricted environment. However, this cleavage accessory can only be used in conjunction with a bra or other garment, and cannot be used alone, greatly narrowing the scope of use of the accessory and limiting its use.

Based on the above problems, it is necessary to propose a new bra structure, which allows the bra to be used alone without relying on other clothing, and has the advantages of comfortable wearing, material saving, recycling, wide range of application and firm fixation to further improve the user's experience.

SUMMARY

The present invention provides a bra cover, comprising a bra, a textile and a sling assembly, Said bra comprises bra strap and at least two pieces bra pads, said bra strap having upper part of the bra strap and lower part of the bra strap, said bra pads being set in the middle of said bra strap;

Said sling assembly comprising at least two shoulder strap and band, said shoulder strap, said band and said bra strap being connected two by two, respectively, to form a closed bra structure that can be supported and fixed;

Wherein one end of said shoulder strap is attached to said upper part of the bra strap, said lower part of the bra strap is attached to said band such that said shoulder strap and said band are attached to said bra, the other end of said shoulder strap is attached to said band, and said textile is attached to said bra strap approximately in the middle of said bra strap, said textile is configured to fit in front of the said bra pads, in combination with said bra.

The present invention also provides an adjustable and removable bra, comprising a fastening kit and a bra cover, Said fastening kit comprising a plurality of attachment buckle and a plurality of adjustment buckle;

Said bra cover, comprising textile and sling assembly, said sling assembly comprising bra strap, at least two shoulder strap, band and at least two bra pads, said bra strap having upper part of the bra strap and lower part of the bra strap, said upper part of the bra strap and said lower part of the bra strap being provided with attachment hole, one end of said shoulder strap being connected to said upper part of the bra strap, said lower part of the bra strap being connected to said band wherein said shoulder strap is provided with shoulder strap hole at one of its ends and said shoulder strap is connected to said band at the other end to form a closed bra structure, and said bra pads is provided in the middle of said bra strap; wherein said textile is connected to said bra strap in the middle of said bra strap, and wherein said textile is configured to be used externally of said bra pads in combination with said sling assembly.

Wherein, attachment buckle is provided where said bra strap is connected to said shoulder strap and said band, respectively, and wherein said adjustment buckle is configured to be used in conjunction with said shoulder strap and said band.

BRIEF DESCRIPTION OF DRAWINGS

In order to explain the technical scheme of this application more clearly, the drawings needed in the implementation will be briefly introduced below. Obviously, the drawings described below are only some implementations of this application. For those skilled in the art, other drawings can be obtained according to these drawings without creative work.

In the drawings.

1000, bra cover; 2000, sling assembly; 2100, bra strap; 2110, upper part of the bra strap; 2120, lower part of the bra strap; 2130, attachment hole; 2200, shoulder strap; 2210, shoulder strap hole; 2300, band; 2400, bra pads; 3000, fastening kit; 3100, attachment buckle; 3110, through hole; 3120, hook; 3200, adjustment buckle; 3210, ring buckle; 4100, textile; 4000, adjustable and removable bra; 5000, bra.

DESCRIPTION OF EMBODIMENTS

While various aspects and features of certain embodiments have been summarized above, the following detailed description illustrates a few exemplary embodiments in further detail to enable one skilled in the art to practice such embodiments. Reference will now be made in detail to embodiments of the inventive concept, examples of which are illustrated in the accompanying drawings. The accompanying drawings are not necessarily drawn to scale. The described examples are provided for illustrative purposes and are not intended to limit the scope of the invention. It should be understood, however, that persons having ordinary skill in the art may practice the inventive concept without these specific details.

It will be understood that, although the terms first, second, etc. may be used herein to describe various elements, these elements should not be limited by these terms. These terms are only used to distinguish one element from another. For example, a first attachment could be termed a second attachment, and, similarly, a second attachment could be termed a first attachment, without departing from the scope of the inventive concept.

It will be understood that when an element or layer is referred to as being "on," "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

As used in the description of the inventive concept and the appended claims, the singular forms "a," "an," and "the" are intended to include the plural forms as well, unless the context clearly indicates other.

Figure 1:
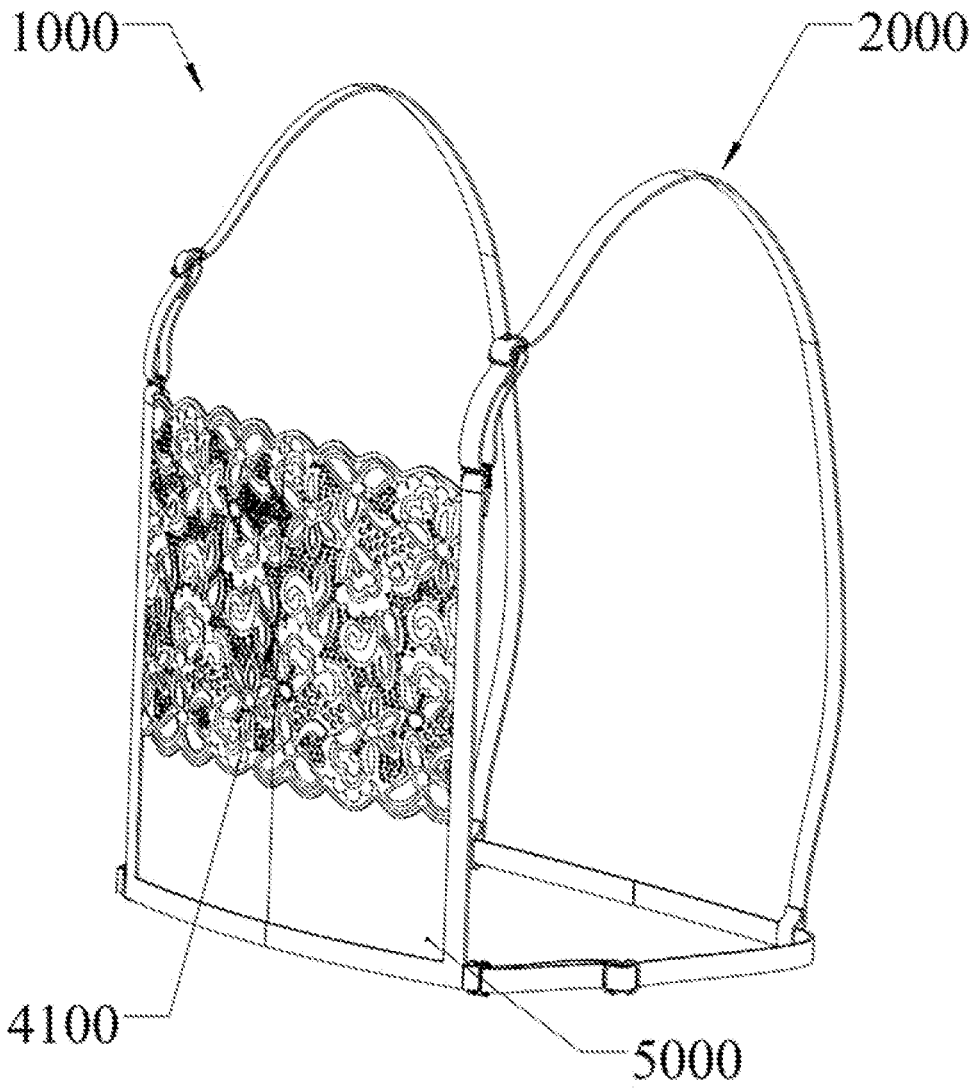
FIG. 1 shows a schematic diagram of the structure of the present invention application.

Referring to FIG. 1, the present invention provides a bra cover 1000 comprising bra 5000, textile 4100 and sling assembly 2000.

Figure 2:
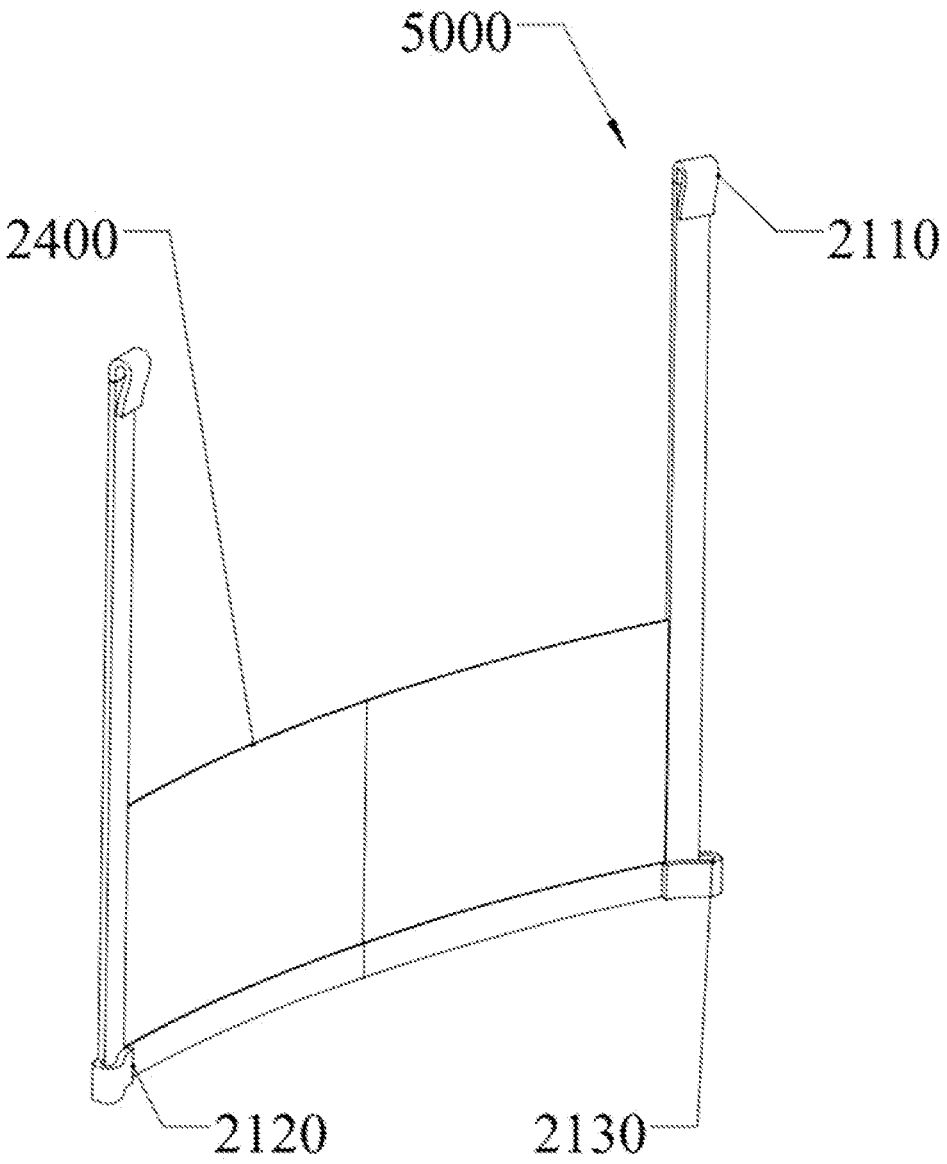
FIG. 2 shows a schematic diagram of the bra of the present invention application.

Referring to FIG. 2, bra 5000 includes bra strap 2100 and at least two pieces bra pads 2400, bra strap 2100 is bent and folded to form an unenclosed substantially rectangular shape, the resulting shape is a "⊔" shape, bra strap 2100 has an upper part of the bra strap 2110 and a lower part of the bra strap 2120, and, in some embodiments, the shape of bra strap 2100 may be a cross shape or a "U" structure or other character shape.

upper part of the bra strap 2110 has bra strap 2100 curved in the vertical direction to form attachment hole 2130, and lower part of the bra strap 2120 has bra strap 2100 curved in the horizontal direction to form attachment hole 2130, and attachment hole 2130 can be used to connect a fixing structure, such as a button structure, or a suspender structure, or a steel ring structure, or other devices that can act as a connecting and stabilizing device.

In this embodiment, the shape of bra strap 2100 is a strip-type structure, and bra strap 2100 is made of silk material, and in some embodiments, the shape of bra strap 2100 may be an arc-shaped structure, a square-shaped structure, or other geometric structures.

Similarly, the material of bra strap 2100 may be made of a flexible material such as a nylon material, or a cotton material, or a polyester material, or a Lycra material.

The approximate rectangle formed by bra strap 2100 has two bra pads 2400 blocks, both of the same size and material, which can be used by users to block the chest and fix its position.

In this embodiment, bra pads 2400 is provided in the middle of bra strap 2100 in a substantially rectangular structure, connected to bra strap 2100 by sewing, and bra pads 2400 is made of textile, optionally, the material of bra pads 2400 can be a flexible textile material such as a cotton cushion material, or a sea surface cushion material, or a silicone cushion material, or an inflatable cushion, and so on.

As a preferred embodiment of the present invention, in order to make the fixing method of bra 5000 more solid, not easy to go out of the light and leakage point, comfortable to wear, widely applicable and can be worn alone, without the need to rely on other clothing, the present invention is attached to bra 5000 with sling assembly 2000 and textile 4100.

Figure 3:
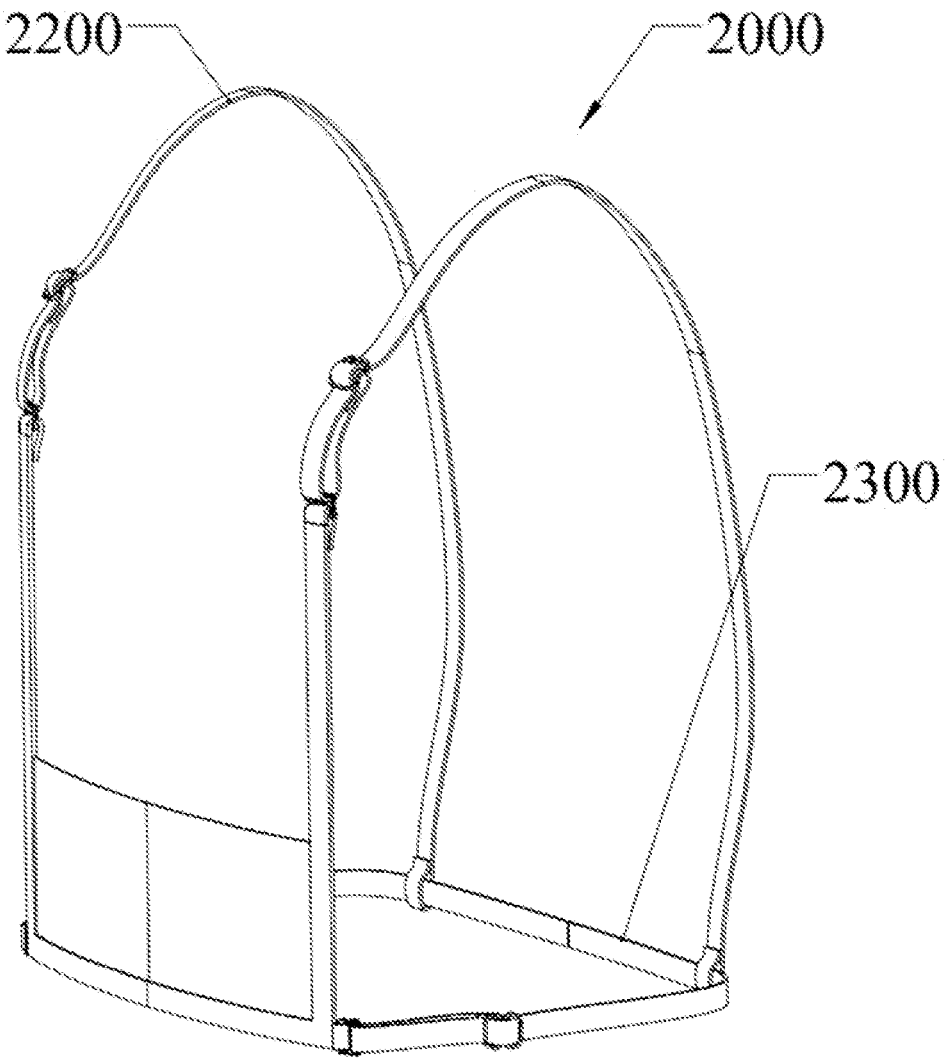
FIG. 3 shows a schematic diagram of the sling assembly of the present invention application.

Referring to FIG. 3 it is shown that sling assembly 2000 comprises at least two strips shoulder strap 2200 and band 2300.

Figure 4:
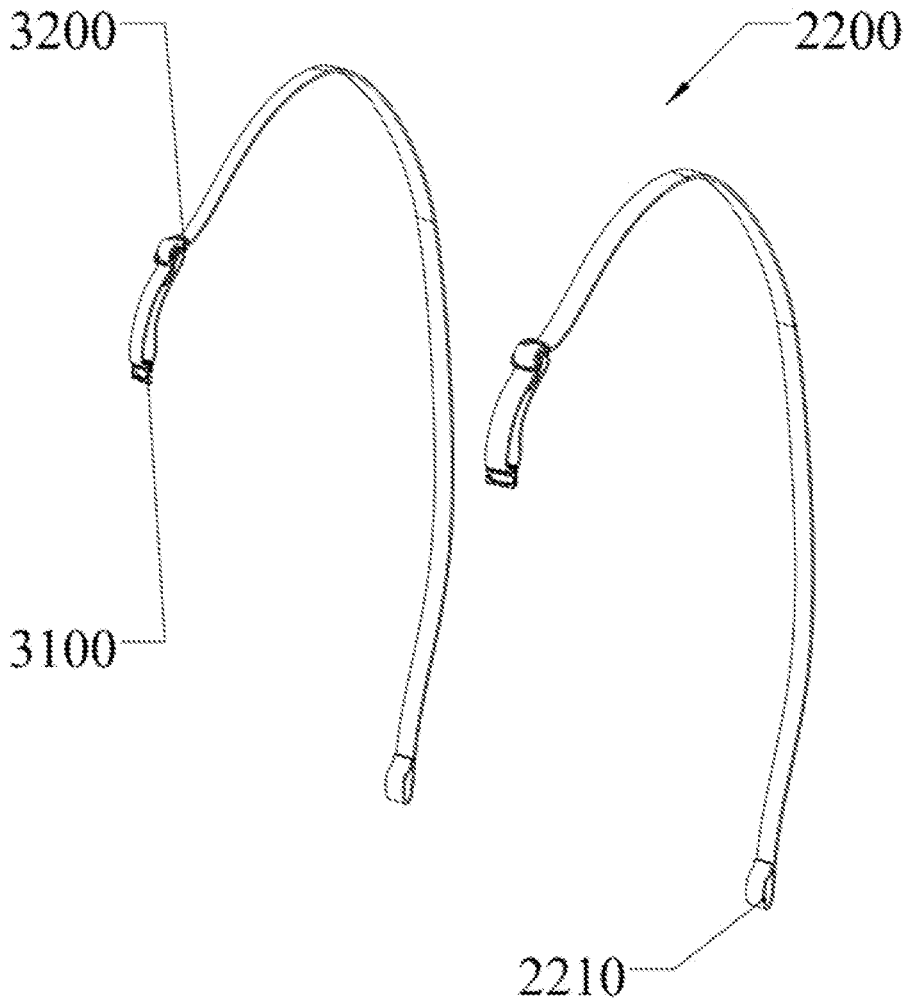
FIG. 4 shows a schematic diagram of the shoulder strap of the present invention application.

Referring to FIG. 4, it is shown that in this embodiment, shoulder strap 2200 is in a strip-type structure and is made of a flexible material, which in some embodiments may also be made of a flexible material such as a nylon material, or a cotton material, or a polyester material, or a Lycra material, and that one of the ends of shoulder strap 2200 is curved and folded over to form a hermetic closure shoulder strap hole 2210, and that the other end of shoulder strap 2200 is coupled to the upper part of the bra strap 2110 of the bra strap 2100 to form a detachable connection to said bra strap 2100 by means of an attachment hole 2130 to form a removable connection with bra strap 2100.

Figure 5:
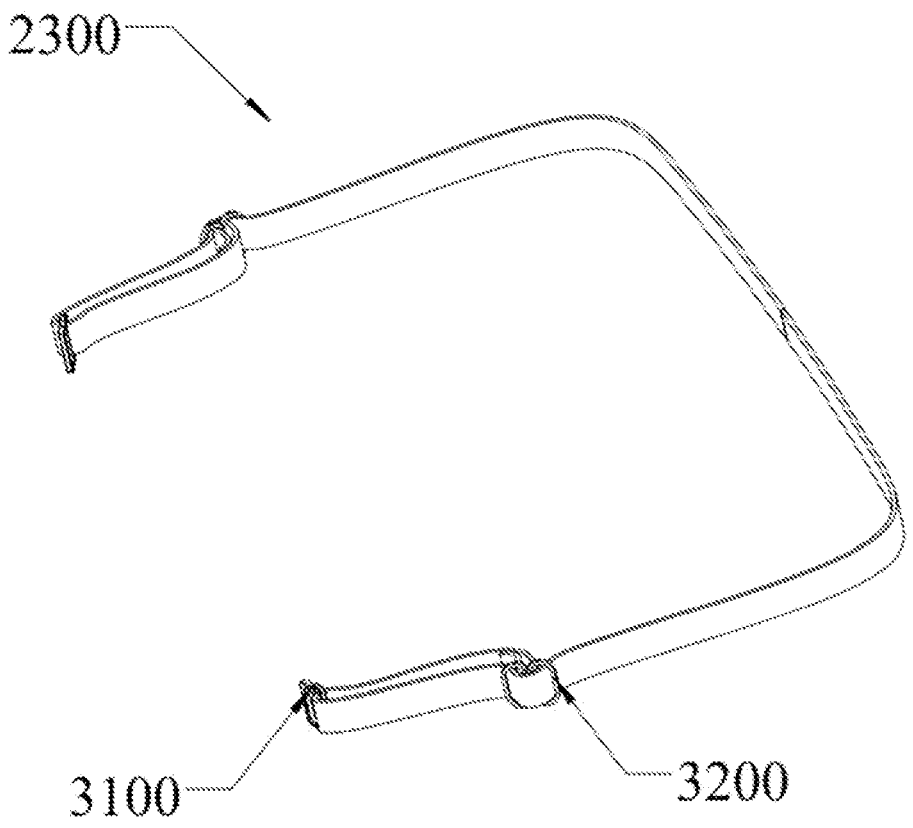
FIG. 5 shows a schematic diagram of the band of the present invention application.

Referring to FIG. 5, band 2300 passes through shoulder strap hole 2210 to form a detachable connection with said shoulder strap 2200, such a connection does not need to rely on any assistance, which makes the overall structure more aesthetically pleasing, and at the same time, completes the connection without the assistance of the rest of the structure, which makes the overall simplicity, and the user will be more comfortable when wearing it, which improves the user's sense of experience.

In this embodiment, band 2300 is in a strip-type structure, made of a flexible material, and in some embodiments, the material may also be made of a flexible material such as a nylon material, or a cotton material, or a polyester material, or a Lycra material, and the two ends of band 2300 are connected to the lower part of the bra strap 2120 of the bra strap 2100 to form a substantially elliptical shape, and form a removable connection with the said bra strap 2100 via the attachment hole 2130.

It is to be further explained that the connecting method of the three of shoulder strap 2200, band 2300 and bra strap 2100 is not limited to the connecting method listed above, and the person skilled in the art may flexibly adjust and set the connecting method of the three of shoulder strap 2200, band 2300 and bra strap 2100 in practical application, such as the Velcro connecting method, or the glued connecting method, or the zipper connecting method, or the buckle connecting method, and other remaining connecting and fixing methods.

Figure 6:
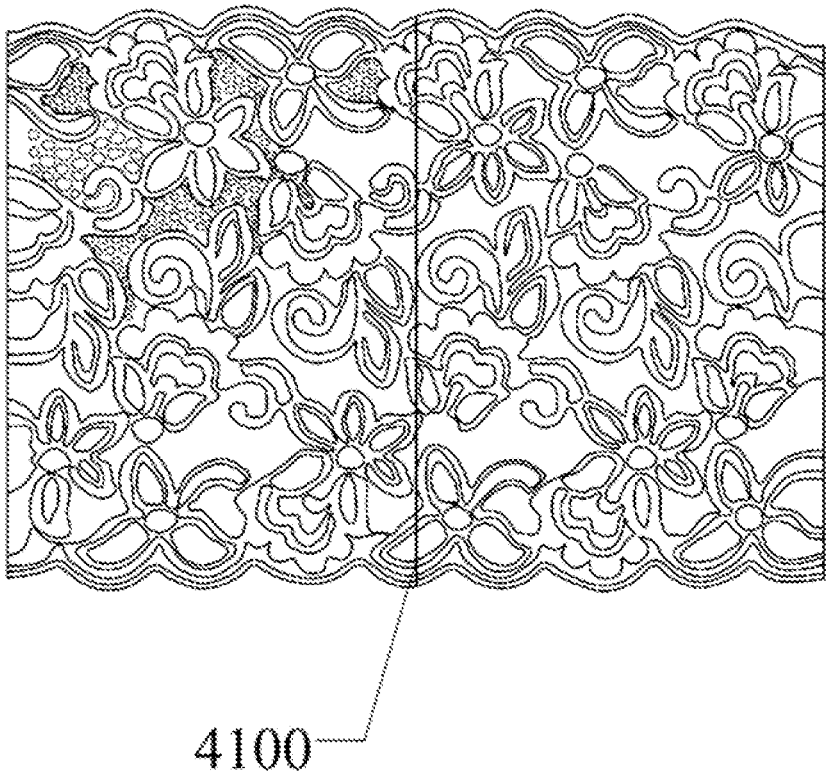
FIG. 6 shows a schematic diagram of the textile of the present invention application.

Referring to FIG. 6, textile 4100 is a piece of bra cover 1000ing, textile 4100 is in a roughly rectangular structure, and is approximately fixed in the middle of said bra strap 2100 by sewing, which is more firmly connected by sewing, and makes the connection part more beautiful, improves the overall visual effect, and is more pleasing to the eye of the user.

It is to be further explained that the connecting method of textile 4100 and bra strap 2100 is not limited to the connecting methods listed above, and the technicians in the field can flexibly adjust and set the connecting method of textile 4100 and bra strap 2100 in practical application, as long as it is possible to make the connecting method of textile 4100 and bra strap 2100 connect in a removable manner, such as the Velcro connecting method, or the glued connecting method, or the zipper connecting method, or the rest of the connecting fixing methods such as the buckle connecting method, and so forth.

In this embodiment, the surface of textile 4100 is provided with decorative patterns, and the upper and lower ends are provided with lace edges, which makes the whole of textile 4100 more beautiful, and the material of textile 4100 is made of textile material, and in other embodiments, the material can also be a flexible textile material, such as a silk material, or a fiber material.

In this embodiment, textile 4100 is set in the front part of bra pads 2400, which is used in combination with the whole bra 5000, and at the same time, the fabric of textile 4100 covers a large range, which can protect the whole chest of the user, and it has the advantages of not easy to get naked and show the spots, and it is elegant and so on.

Figure 7:
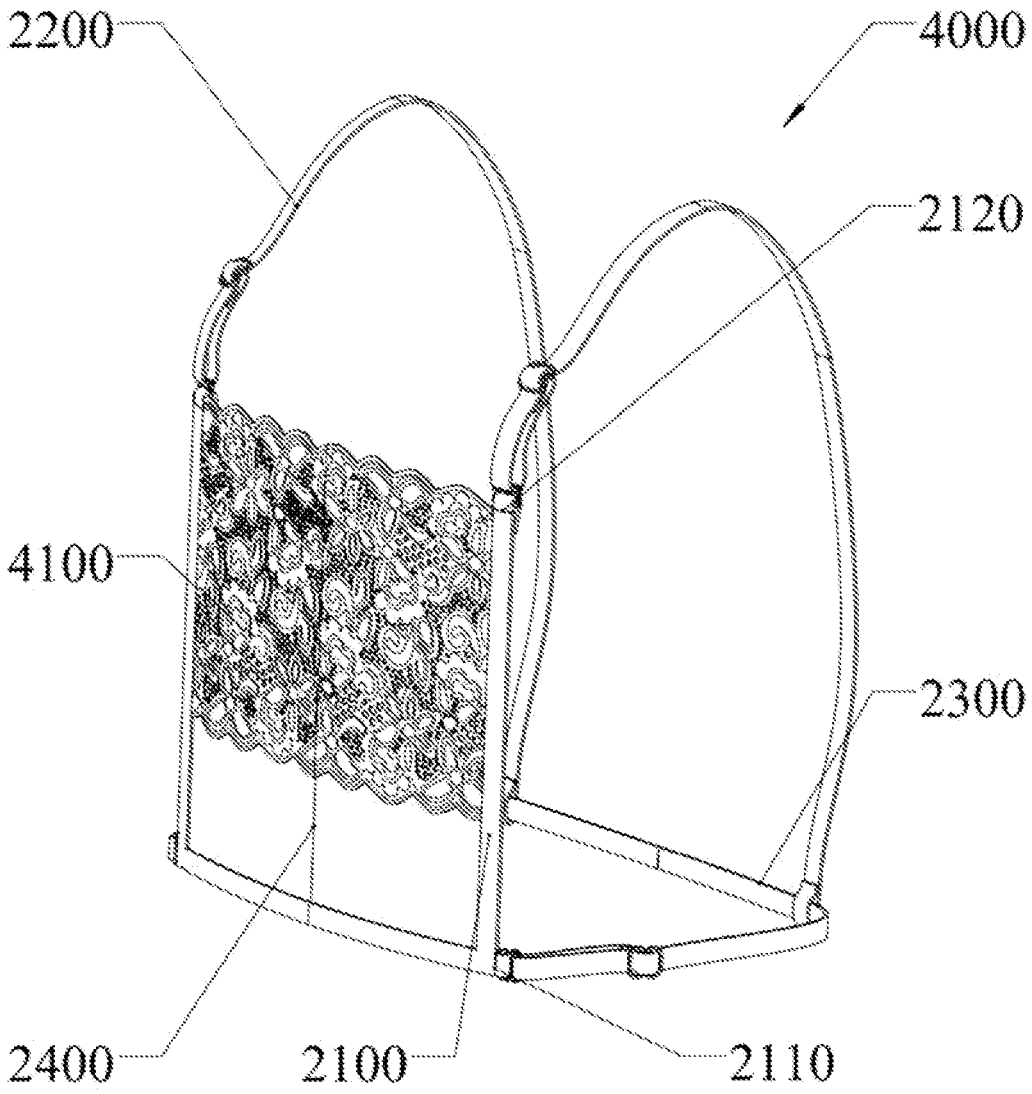
FIG. 7 shows a schematic diagram of the overall structure of the present invention application.

Referring to FIG. 7, specifically, when bra 5000, textile 4100 and sling assembly 2000 form a connection, one of the two ends of shoulder strap 2200 is connected to the two top corners of upper part of the bra strap 2110, respectively, around an arc shape, and bends and folds over at the other end to form a hermetically sealed shoulder strap hole 2210; one of the ends of band 2300 is connected to one of the bottom corners of lower part of the bra strap 2120, and the other end passes through the two shoulder strap 2200 to form a detachable connection with shoulder strap 2200, and finally is connected to another bottom corner of lower part of the bra strap 2120, forming a roughly oval shape, and shoulder strap 2200, band 2300 and bra strap 2100 are connected two by two, respectively. Shoulder strap 2200 to form a removable connection, and finally connects with another bottom corner of lower part of the bra strap 2120 to form a roughly oval shape. Shoulder strap 2200, band 2300 and bra strap 2100 are connected two by two respectively to form a closed structure that can be supported and fixed; textile 4100 where three of the edges are sewn on bra 5000, located in front of bra pads 2400, to cover the whole bra 5000.

The present invention application adds a strip shoulder strap 2200 and band 2300, which can make the bra without shoulder strap 2200 to be used alone without relying on other garments, and textile 4100 can cover a large area of bra 5000, so that the present invention application is not prone to go out of the light or leakage of the point, and at the same time, shoulder strap 2200 and band 2300 are the independent carriers with independent fixing ability of the product, removing the traditional fixing method by band 2300 with the shoulder strap 2200 for cross-fixing, so that the product of the present invention is more comfortable to wear, can be worn alone, do not need to attach to other clothing and can be applied to any clothing.

As a preferred embodiment of the present invention, in order to make the application of the present invention applicable to a variety of people, and to play the role of environmental protection and material saving. The present invention also provides an adjustable and removable bra 4000.

Figure 8:
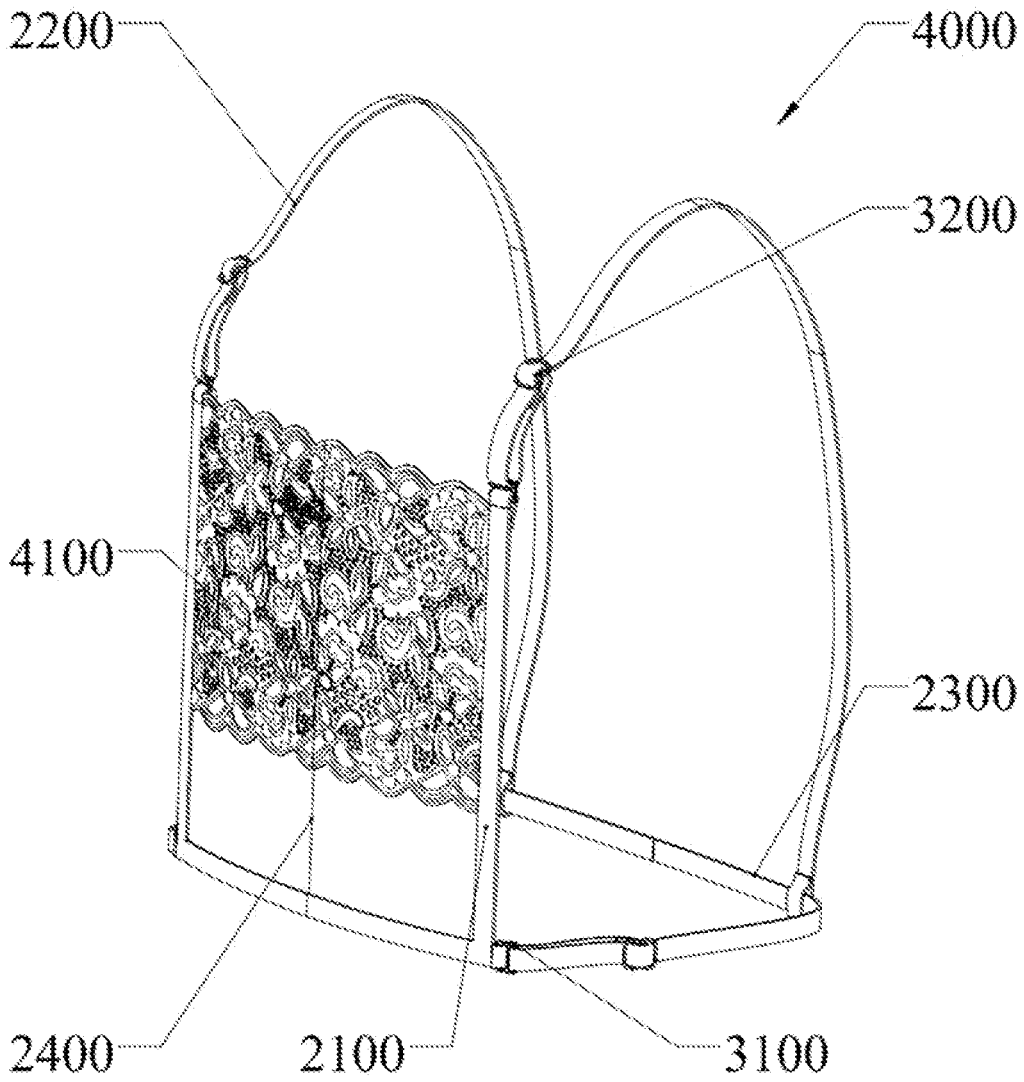
FIG. 8 shows a schematic diagram of the structure with fastening kit attached.

Referring to FIG. 8, an adjustable and removable bra 4000 is shown, comprising fastening kit 3000 and bra cover 1000, the adjustable and removable bra 4000 having fastening kit 3000 added to bra cover 1000.

Figure 9:
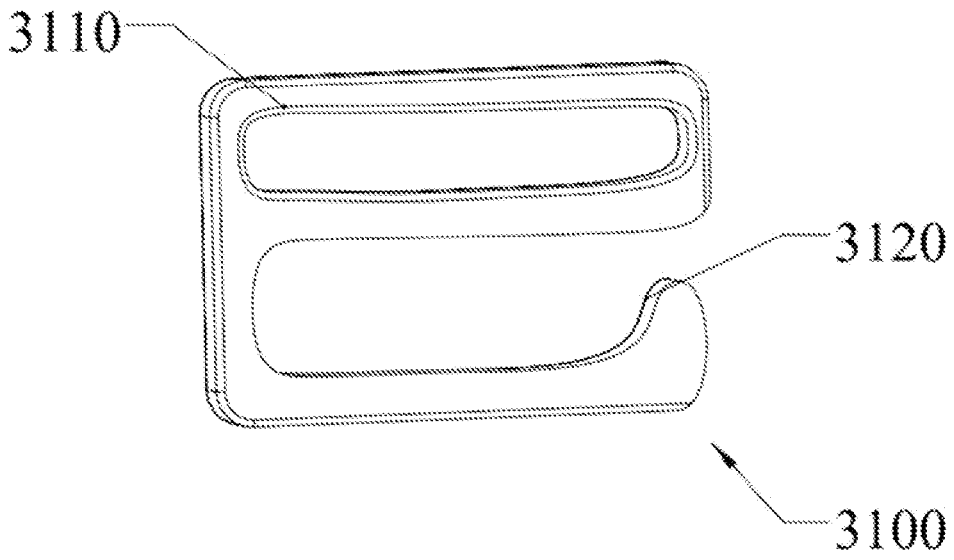
FIG. 9 shows a schematic diagram of the attachment buckle of the present invention application.

Referring to FIG. 9, fastening kit 3000 includes a plurality of attachment buckle 3100 and a plurality of adjustment buckle 3200, and in this embodiment, attachment buckle 3100 is in a "⊟" structure, and in some embodiments, the overall shape of attachment buckle 3100 may be in other structures as long as it can be made possible to make the attachment buckle 3100 have a function of being removable and connectable.

Referring to FIGS. 8 and 9, attachment buckle 3100 is provided with through hole 3110 and hook 3120, hook 3120 is hooked to attachment hole 2130, thereby forming a connection with upper part of the bra strap 2110 and lower part of the bra strap 2120 of bra 5000, and one of the ends of shoulder strap 2200 and band 2300 passes through hole 3110 of attachment buckle 3100 to form a removable connection with upper part of the bra strap 2110 and lower part of the bra strap 2120, respectively.

Figure 10:
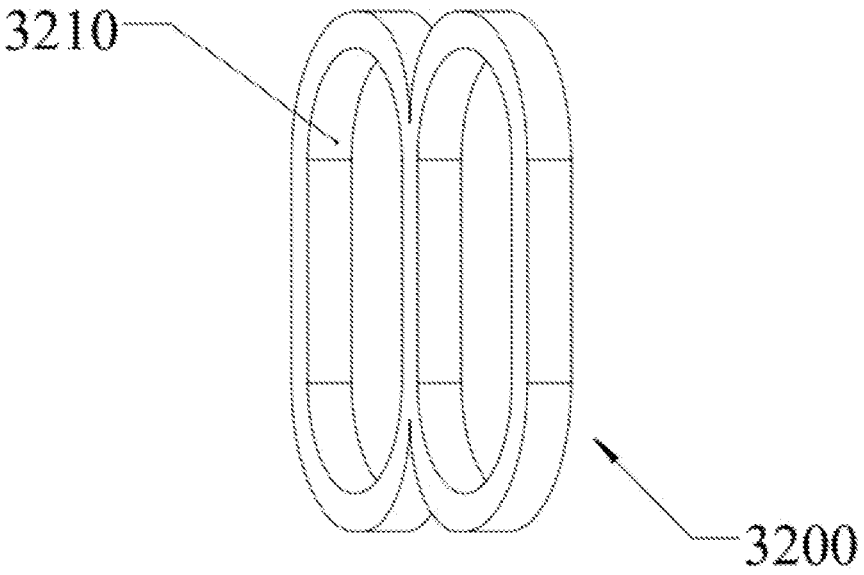
FIG. 10 shows a schematic diagram of the adjustment buckle of the present invention application.

Referring to FIG. 10, adjustment buckle 3200 consists of at least two ring buckle 3210, and adjustment buckle 3200 is in the shape of an "8" structure, similarly, the shape of adjustment buckle 3200 is not limited to the connection method listed above, and the person skilled in the art can flexibly adjust and set the shape of adjustment buckle 3200 in practical application, as long as the shape of adjustment buckle 3200 can make the through hole 3110 of shoulder strap 2200 and band 2300 form a detachable connection relationship with upper part of the bra strap 2110 and lower part of the bra strap 2120, respectively. Shoulder strap 2200 and band 2300 to be adjusted.

Referring to FIGS. 8 and 10, adjustment buckle 3200 is provided above shoulder strap 2200 and band 2300, respectively, and when shoulder strap 2200 and band 2300 pass through hole 3110 and bra 5000 to form a connection, shoulder strap 2200 and band 2300 pass through adjustment buckle 3200 after folding to form an adjustable connection.

The materials of attachment buckle 3100 and adjustment buckle 3200 are both plastic materials, and it should be further explained that the materials of attachment buckle 3100 and adjustment buckle 3200 are not limited to the above-listed connection methods, and the technicians in the field can flexibly adjust and set up the materials of attachment buckle 3100 and adjustment buckle 3200 in practical applications, such as plastic materials, or metal materials, or natural materials, and so on.

Specifically, on the basis of the original bra cover 1000, attachment buckle 3100 is provided at the connection between bra strap 2100 and shoulder strap 2200, and at the connection between bra strap 2100 and band 2300, and hook 3120 of attachment buckle 3100 is clasped with attachment hole 2130 on upper part of the bra strap 2110 and lower part of the bra strap 2120 respectively by hook and loop fasteners, so that shoulder strap 2200 and band 2300 are removable, and there is an adjustment buckle 3200 at both ends of band 2300 and adjustment buckle 3200 is located at both ends of band 2300, and there is a bra pads 2400 at the end of band 2300, and there is an bra pads 2400 on the end of band 2300, and there is an bra pads 2400 on the end of band 2300. Both shoulder strap 2200 have adjustment buckle 3200, adjustment buckle 3200 is located at the ends of band 2300, shoulder strap 2200 and band 2300 pass through hole 3110, and then inserted into the two-ring buckle 3210 of adjustment buckle 3200 through bending, thus the size and looseness can be adjusted.

Adjustable and removable bra 4000's shoulder strap 2200 and band 2300 are adjustable and can be flexibly adjusted according to different obesity levels and different bust girls on the market, which is suitable for all kinds of people. At the same time, the four corners of adjustable and removable bra 4000 can be disassembled and connected, which can be used in the case of only replacing bra 5000, complete replacement of the old and the new or the color, which makes it possible to reuse shoulder strap 2200 and band 2300 for a long period of time and thus avoiding the material waste problem, and has the characteristic of environmental protection.

In summary, the present invention application provides a brand-new bra structure, which enables the bra to be used alone without relying on other apparel, and has the advantages of comfortable wearing, material saving, recycling, wide range of application and firm fixation, which further improves the user's sense of experience.

The technical means disclosed in the scheme of the present invention are not limited to the technical means disclosed in the above embodiments, but also include the technical scheme composed of any combination of the above technical features. It should be pointed out that for those skilled in the art, several improvements and embellishments can be made without departing from the principle of the present invention, and these improvements and embellishments are also regarded as the protection scope of the present invention.

The invention has now been described in detail for the purposes of clarity and understanding. However, those skilled in the art will appreciate that certain changes and modifications may be practiced within the scope of the appended claims.

What is claimed:

1. A bra cover, comprising:

a bra, a textile and a sling assembly, said bra comprises a bra strap and at least two pieces of bra pads, said bra strap having an upper part of the bra strap and a lower part of the bra strap, said bra pads being set in a middle of said bra strap, the upper part of the bra strap curved in a vertical direction to form a first attachment hole and the lower part of the bra strap curved in a horizontal direction to form a second attachment hole;

said sling assembly comprising at least two shoulder straps and band, said at least two shoulder straps, said band and said bra strap being connected two by two, respectively, to form a closed bra structure that is supported and fixed;

wherein one of each end of said at least two shoulder straps is attached to said upper part of the bra strap through the first attachment hole to form a removable connection, said lower part of the bra strap is attached to said band through the second attachment hole such that said at least two shoulder straps and said band are attached to said bra, other end of said at least two shoulder straps is attached to said band, and said textile is attached to said bra strap approximately in the middle of said bra strap, said textile is configured to fit in front of the said bra pads, in combination with said bra.

2. The bra cover according to claim 1, wherein said textile is in a substantially rectangular structure, secured to said bra strap by means of sewing, and that the bottom of said textile is connected to said bra pads.

3. The bra cover according to claim 2, wherein said textile is provided with a decorative pattern, said textile being made of textile material.

4. The bra cover according to claim 3, wherein said bra pads have a substantially rectangular structure and is connected to said bra strap by means of sewing, said bra pads being made of textile material.

5. The bra cover according to claim 4, wherein said bra strap has a strip type structure and is made of flexible material.

6. The bra cover according to claim 1, wherein said at least two shoulder straps forms a detachable connection with said bra strap through said first attachment hole.

7. The bra cover according to claim 6, wherein said at least two shoulder straps is of a strip-type structure, made of flexible material, and one of the ends of said at least two shoulder straps is bent and folded to form an airtight shoulder strap hole.

8. The bra cover according to claim 7, wherein said band passes through said shoulder strap hole to form a connection with said at least two shoulder straps.

9. The bra cover according to claim 8, wherein said band have a strip type structure and is made of flexible material, and said band forms a detachable connection with said bra strap through said attachment hole.

10. An adjustable and removable bra, comprising:

a fastening kit and a bra cover, said fastening kit comprising a plurality of attachment buckle and a plurality of adjustment buckle;

said bra cover, comprising textile and sling assembly, said sling assembly comprising bra strap, at least two shoulder strap, band and at least two bra pads, said bra strap having an upper part of the bra strap and a lower part of the bra strap, said upper part of the bra strap curved in a vertical direction to form a first attachment hole and said lower part of the bra strap curved in a horizontal direction to form a second attachment hole, one end of said at least two shoulder straps being connected to said upper part of the bra strap through the first attachment hole to form a removable connection, said lower part of the bra strap being connected to said band through the second attachment hole, wherein each of shoulder strap of the at least two shoulder straps is provided with shoulder strap hole at one of its ends and said at least two shoulder straps is connected to said band at the other end to form a closed bra structure, and said bra pads is provided in the middle of said bra strap; wherein said textile is connected to said bra strap in the middle of said bra strap, and wherein said textile is configured to be used externally of said bra pads in combination with said sling assembly;

wherein, attachment buckle is provided where said bra strap is connected to said at least two shoulder straps and said band, respectively, and wherein said adjustment buckle is configured to be used in conjunction with said at least two shoulder straps and said band.

11. The adjustable and removable bra according to claim 10, wherein said attachment buckle is in the form of a "目" structure, and said attachment buckle has through hole and hook.

12. The adjustable and removable bra according to claim 11, wherein said attachment buckle is hooked in said first attachment hole through said hook.

13. The adjustable and removable bra according to claim 12, wherein said through hole is connected to said at least two shoulder straps or said band such that said bra strap forms a detachable connection with said at least two shoulder straps and said band respectively.

14. The adjustable and removable bra according to claim 13, wherein said adjustment buckle comprises at least two ring buckles, said adjustment buckle being in the shape of an "8".

15. The adjustable and removable bra according to claim 14, where in the other end of said at least two shoulder straps forms an adjustable connection with said adjustment buckle by means of a folded form.

16. The adjustable and removable bra according to claim 15, where in both ends of said band form an adjustable connection with said adjustment buckle through a folded form.

17. The adjustable and removable bra according to claim 16, wherein said attachment buckle and said adjustment buckle are made of plastic material.

* * * * *